US008408737B2

(12) United States Patent
Wright et al.

(10) Patent No.: US 8,408,737 B2
(45) Date of Patent: Apr. 2, 2013

(54) LIGHT EMITTING DIODE SIGN LIGHTER

(75) Inventors: Timothy Wright, Peachtree City, GA (US); Wei Rong, Peachtree City, GA (US); Gerry Thornton, Sharpsburg, GA (US)

(73) Assignee: Cooper Technologies Company, Houston, TX (US)

( * ) Notice: Subject to any disclaimer, the term of this patent is extended or adjusted under 35 U.S.C. 154(b) by 494 days.

(21) Appl. No.: 12/721,204

(22) Filed: Mar. 10, 2010

(65) Prior Publication Data

US 2011/0219650 A1 Sep. 15, 2011

(51) Int. Cl.
*F21V 7/00* (2006.01)

(52) U.S. Cl. ..... 362/247; 362/235; 362/236; 362/237

(58) Field of Classification Search ..... 362/294, 362/345, 373, 800, 235–243
See application file for complete search history.

(56) References Cited

U.S. PATENT DOCUMENTS

| | | | | |
|---|---|---|---|---|
| D125,468 | S | 2/1941 | Dreyfuss | |
| 2,715,449 | A | 8/1955 | Smith et al. | |
| D191,062 | S | 8/1961 | Gross | |
| D401,001 | S | 11/1998 | Herst et al. | |
| 6,250,774 | B1 | 6/2001 | Begemann et al. | |
| D556,935 | S | 12/2007 | Quioque et al. | |
| D576,330 | S | 9/2008 | Ruud et al. | |
| 7,513,639 | B2 | 4/2009 | Wang | |
| D603,077 | S | 10/2009 | Kinnune et al. | |
| D607,598 | S | 1/2010 | Xiao et al. | |
| 7,665,862 | B2 | 2/2010 | Villard | |
| D619,749 | S | 7/2010 | Jong | |
| D632,416 | S | 2/2011 | Wright | |
| 2007/0183148 | A1 | 8/2007 | Mayfield et al. | |
| 2008/0186703 | A1* | 8/2008 | Lou et al. | 362/247 |
| 2008/0212329 | A1 | 9/2008 | Duguay et al. | |
| 2009/0141494 | A1* | 6/2009 | Zhang et al. | 362/249.03 |
| 2009/0168422 | A1 | 7/2009 | Chiu et al. | |
| 2009/0244894 | A1 | 10/2009 | Zhou | |
| 2009/0251898 | A1 | 10/2009 | Kinnune et al. | |
| 2010/0149809 | A1 | 6/2010 | Ruud et al. | |
| 2011/0063832 | A1* | 3/2011 | Hu et al. | 362/235 |
| 2011/0133670 | A1* | 6/2011 | Lee et al. | 362/249.02 |

FOREIGN PATENT DOCUMENTS

| | | |
|---|---|---|
| KR | 10-2009-0043215 | 5/2009 |
| KR | 10-0942000 | 2/2010 |

OTHER PUBLICATIONS

International Search Report for PCT/US2010/046326 mailed on Apr. 28, 2011.

* cited by examiner

*Primary Examiner* — William Carter
(74) *Attorney, Agent, or Firm* — King & Spalding LLP

(57) ABSTRACT

A light emitting diode (LED) sign lighter is positioned to illuminate a sign. One or more LED modules on the LED sign lighter are directed toward different portions of the sign. Each LED module is configured with a reflector or over-optic to control the angle of the light emitted toward the sign. Each LED module includes an array of LEDs. The configuration of each LED module within the LED sign lighter helps to reduce the build-up of environmental contaminants on the LED module. The center section of the LED sign lighter includes a compartment for housing electrical components to power the LED modules. Heat sink fins are oriented along the back side of the LED sign lighter to provide thermal efficiency for the LED modules.

15 Claims, 10 Drawing Sheets

LIGHT EMITTING DIODE SIGN LIGHTER

FIELD OF THE INVENTION

The present invention relates generally to luminaires. More specifically, the embodiments of the invention relate to a sign lighter luminaire with LED light sources.

BACKGROUND

Light emitting diodes (LEDs) are a type of semi-conductor device that emits visible light when biased in the forward direction. LEDs are typically smaller than standard bulb or filament type lamps, making LEDs desirable in applications where space is limited. A single LED typically produces less illumination than that of a standard light bulb. Therefore, in some applications, a plurality of LEDs may be combined in an array or other fashion to provide the same degree of illumination provided by one or more standard conventional lamps.

LEDs typically produce consistent and clear light that is more pleasant than conventional lamps. Also, unlike standard bulb lamps, LEDs do not have a high fail rate because they do not require a filament to produce light. Instead, light emitted by a LED is created by the generation of photons from materials within the LED. Accordingly, striations—which are present in convention filament-produced light sources—are not present with LEDs.

Conventional lamps are used for a variety of purposes, such as lighting industrial, commercial, and governmental applications. A light may be used by a government agency or commercial business, for example, to illuminate a sign along a roadway. Assemblies used for this purpose are typically called sign lighters. Conventional sign lighters typically comprise a housing containing a single lamp, such as a metal halide lamp. The conventional sign lighter is typically held perpendicular to the sign so as to direct light upwards to illuminate the sign. In this way, the sign may be read at night or during dark portions of the day.

Conventional sign lighters, however, typically consume vast amounts of energy and have a short life span. Maintenance costs, including the costs for replacing such conventional lamps can also be excessive. This is especially true for government or commercial entities who must ensure that sign lighters are active at all times.

In addition to the aforementioned problems, conventional sign lighters have additional problems such as excessive light spill (i.e., the light emitted from the sign lighter illuminates areas beyond the dimensions of the sign that are not intended to be illuminated) and striations. Additionally, the short life of bulbs and the effect of the light provided from conventional bulbs tend to wane over time. The color produced by conventional sign lighters, for example, has an undesirable yellow tint that becomes increasingly more pronounced and less desirable to users over time.

In comparison, LEDs are generally more energy efficient, more reliable, and last longer than conventional types of lighting, such as metal halide lamps. Despite this, LEDs have heretofore not been incorporated into applications to provide light for illuminating signs or for other commercial or governmental applications, such as street lamps. Further, LEDs have not been incorporated into a housing or system which can be retrofitted to replace existing metal halide and other conventional sign lighters.

SUMMARY

The inventive LED sign lighter described herein solves the aforementioned problems by providing an efficient, long-lasting, non-striated, and pleasant light source for illuminating a variety of applications, including but not limited to, lighting sides of buildings, Department of Transportation roadway signs, and commercial or governmental billboard signs. The inventive LED sign lighter may include an assembly for housing one or more LED modules, one or more electrical drivers to power the LED modules, and a heat sink preferably molded into the assembly to help alleviate heat caused by the normal use of one or more LEDs in each LED module. In an exemplary embodiment, each LED module or quadrant includes an array of LEDs connected to an electrical source, such as an electrical driver supplying power to each LED module. The LED module may further include one or more reflectors or over-optics to control the angle of the light emitted from each LED. The module may also include a cover for protecting the LEDs, as well as other features, such as a gasket and frame to prevent rain, sleet, or snow from entering the area where the LEDs are maintained. Each LED module may include any number of LEDs in any number of arrays. In an exemplary embodiment, an array of 4×5 LEDs may be used for a LED module.

The assembly for the LED sign lighter preferably is a diecast comprising metal or any other acceptable housing material (e.g., plastic). In an exemplary embodiment, the assembly may provide platforms for one or more LED modules and a center compartment for storing electrical components (e.g., drivers) that in turn provide power to the LED modules.

According to an exemplary embodiment, the LED sign lighter may include two or more platforms for LED modules pointed in such a direction as to light a sign under a variety of conditions. Use of the LED sign lighter is advantageous over conventional sign lighters because it can be more energy efficient, reliable, and longer lasting. Also, unlike conventional lamps, the LED sign lighter does not produce striations, is less resistant to light spill, and allows for the replacement of individual components as opposed to replacing the entire assembly. Additionally, in an exemplary embodiment, the LED sign lighter may be retrofitable so that it can be applied to applications where conventional sign lighters are currently used.

One embodiment of the LED sign lighter described herein may include varying sized reflectors applied to the LED modules in such a way as to distribute light evenly over a sign. In a preferred, yet exemplary, embodiment, the inventive LED sign lighter may include six quadrants: two quadrants on the bottom of the LED sign lighter to light the top of a sign; two quadrants in the middle to light the middle of a sign; and two quadrants at the top to light the bottom of a sign. Advantageously, the bottom, middle, and top quadrant LED modules are manufactured in configurations to accomplish the above functions. For example, the bottom LED modules may be angled at a slight-from-horizontal angle so as to face the top portion of the sign under normal installation (as shown in the attached drawings). Similarly, the middle and top LED modules may have angles of increasing degrees from the horizontal angle to light their respective portions of the sign. While specific embodiments are illustrated herein, it is noted that the present invention covers any varying number of configurations and should not be construed to be limited to the angles and configurations illustrations in the drawings attached hereto.

In yet a further exemplary embodiment, the two LED modules in the top of the sign lighter may use wider angle reflectors or over-optics than the middle and bottom quadrants. This is done because the LED modules in the top of the LED sign lighter will typically be in closer proximity to the sign to be illuminated than the LED modules in the lower quadrants. Therefore, the top LED modules require a wider beam LED light to ensure even and distributed light to cover the bottom portion of the sign while also having minimal spill of light. One of ordinary skill in the art knows how to effectively design over-optics or reflectors of varying angles to suite designs for LEDs based on the specifications of an area intended to be covered by the light.

An exemplary embodiment of the LED sign lighter will further be configured to have outward sloping (from center) angles for each LED light module. The slight slope of the LED modules outward from the center of the assembly (as illustrated in the Figures appended hereto) helps prevent rain, sleet, and snow from accumulating on the LED sign lighter, thus allowing the LED sign lighter to provide even and distributed light even during and after inclement weather conditions.

Unlike conventional lights, the LED sign lighter may be shipped from a manufacture with the LED modules pre-set for installation. For instance, a sign that has an area of 10×15 feet may be provided an LED sign lighter that is manufactured specifically for such an installation. The reflectors and angle of the LED modules in the assembly, for example, may be pre-set to provide optimal light coverage for the application. Such an LED sign lighter helps remove errant lighting caused by shipping damage or improper installation of the sign lighter. Improper installation is common in conventional sign lighters, which require a technician to orient the direction of the lamp only after the assembly has been installed.

In a further exemplary embodiment of the LED sign lighter, the back side of the LED sign lighter assembly may be manufactured with one or more cooling fins that provide thermal efficiency for the LED modules. These cooling fins provide for an enhanced method of cooling the LEDs stored in each LED module. Because the LED modules and heatsink are assembled into one piece (i.e., the housing assembly), the likelihood of overheating the LEDs is minimized. The increase in thermal efficiency is also advantageous as it tends to extend the fixture life for the LEDs and corresponding LED electrical drivers.

Further features of the LED sign lighter will become apparent to one of ordinary skill in the art through the detailed description and drawings provided herein.

BRIEF DESCRIPTION OF THE DRAWINGS

For a more complete understanding of the exemplary embodiments of the present invention and the advantages thereof, reference is now made to the following description in conjunction with the accompanying drawings in which.

Figure 1:
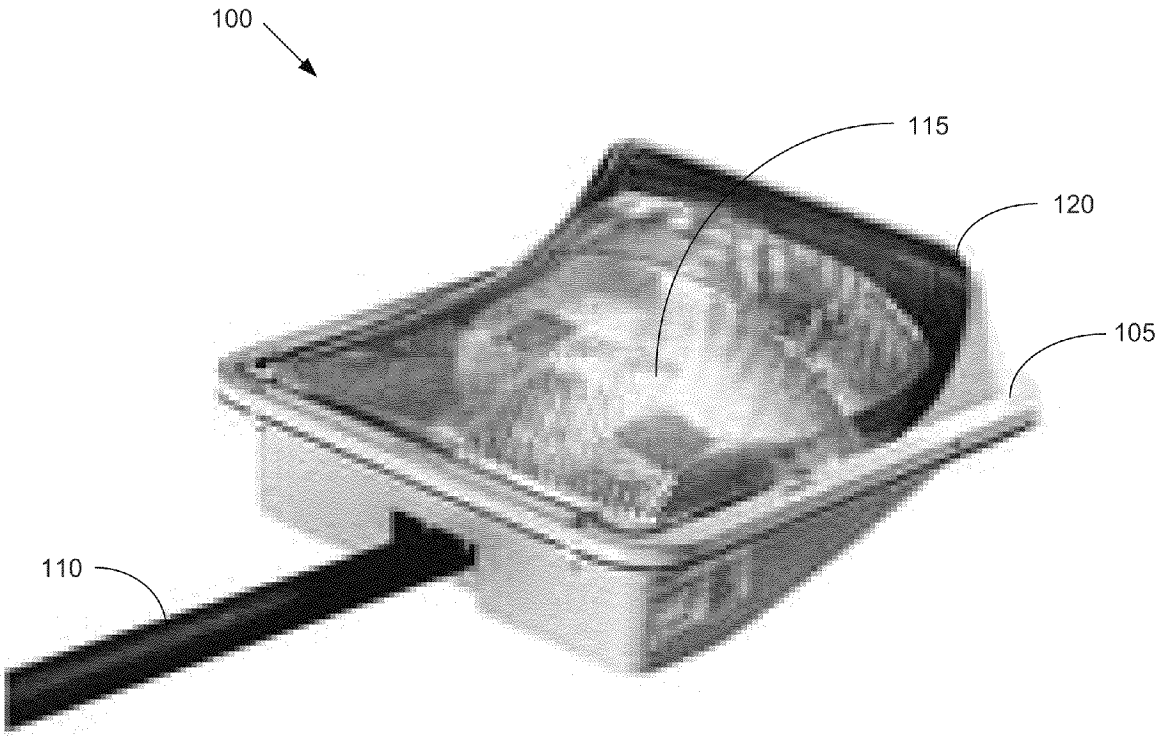
FIGURE 1 (Prior Art)
FIG. 1 is a perspective view of a conventional sign lighter.

Many aspects of the invention can be better understood with reference to the above drawings. The elements and features shown in the drawings are not necessarily to scale, emphasis instead being placed upon clearly illustrating the principles of exemplary embodiments of the present invention. Additionally, certain dimensions may be exaggerated to help visually convey such principles. In the drawings, reference numerals designate like or corresponding, but not necessarily identical, elements throughout the several views.

DETAILED DESCRIPTION

The exemplary LED sign lighter described herein provides an efficient, reliable, and long-lasting light source for illuminating signs, such as billboards and overhead roadway directional signs. The LED sign lighter operates more efficiently than conventional sign lighters, and provides a light source that is not subject to striation and excessive light spill, which are common problems associated with conventional sign lighters, such as those that rely on metal halide lamps.

The LED sign lighter includes a housing to which all the various components of the LED sign lighter are affixed or positioned therein. In one exemplary embodiment, the position and angle settings for mounting the LED light modules in the housing are pre-set and pre-fabricated so as to require no setting of angles for the discrete LED lighting modules by an installer of the unit, thus reducing human errors commonly associated with poorly aiming the light source. The LED sign lighter housing is preferably fabricated as a single diecast piece; however, those or ordinary skill in the art will recognize that the housing may be molded or otherwise manufactured with multiple discrete parts that together create a substantially similar housing. One or more LED modules is affixed to the housing and oriented outward and/or downward such as to prevent snow, sleet, ice, and rain from accumulating on the housing and hindering the performance of the LEDs. In one exemplary embodiment, each LED module includes an array of LEDs having reflectors or overoptics provided therewith to adjust the angle of the light being emitted from each LED individually and/or multiple LEDs together on the LED module. The exemplary LED module also includes a plastic or glass cover for protecting the LED array from the elements.

The housing for the LED sign lighter further includes a heat sink built into the diecast housing to provide thermal relief for the LED modules. In an exemplary embodiment, the back portion of the housing includes cooling fins or ribbons located approximately underneath each LED module.

FIG. 1 is an illustration of a conventional sign lighter 100. As shown, a conventional light 100 includes a lighting housing 105 affixed to the end of a light holder 110. The housing 105 includes a single lamp 115, such as a halogen or metal halide lamp. A light reflector or director 120 is also typically included to direct the light upwards and outwards towards the sign. Notably, the use of this type of conventional light has little to no control over the spread of light, and will accordingly typically produce light spill in excess of the dimensions of the sign. Additionally, because conventional sign lighters use filament-type lamps, striations and shadowing are commonly associated with the sign lighter 100 shown in FIG. 1.

Figure 2:
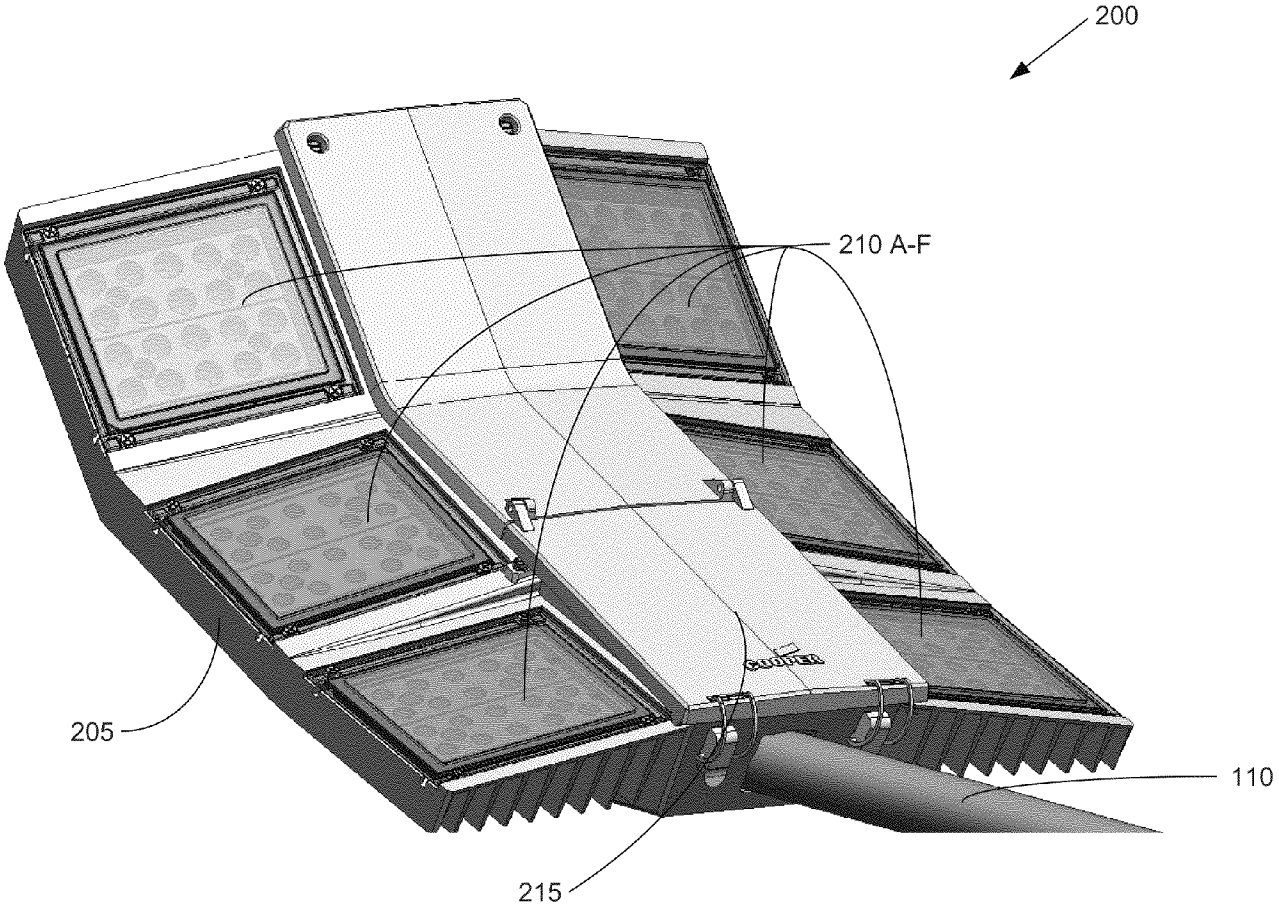
FIG. 2 is a perspective view of a LED sign lighter, according to one exemplary embodiment of the present invention.

FIG. 2 illustrates a LED sign lighter 200, according to an exemplary embodiment of the present invention. As shown, the LED sign lighter 200 includes a diecast housing 205, one or more LED modules 210 A-F, and a compartment cover 215 to protect electrical components (not shown) from weather. In the exemplary embodiment shown in FIG. 2, the LED sign lighter 200 includes six LED modules 210 A-F; however, greater or fewer numbers of LED modules 210 may be used based on the design needs of a specific application. In one exemplary embodiment, each of these LED modules 210 A-F is aimed in a different direction so as to illuminate different portions of a sign of any number of sizes. As further shown in the exemplary embodiment of FIG. 2, the housing 205 is configured to receive and be coupled to a conventional light holder 110. In one exemplary embodiment, the light holder 110 is a metal tube or cylindrical bar that extends outward in a substantially orthogonal direction from the sign being illuminated or the structure holding the sign being illuminated. By doing so, the LED sign lighter housing 205 is capable of being coupled to existing signs in a retrofit application that replaces conventional sign lighters.

Figure 3:
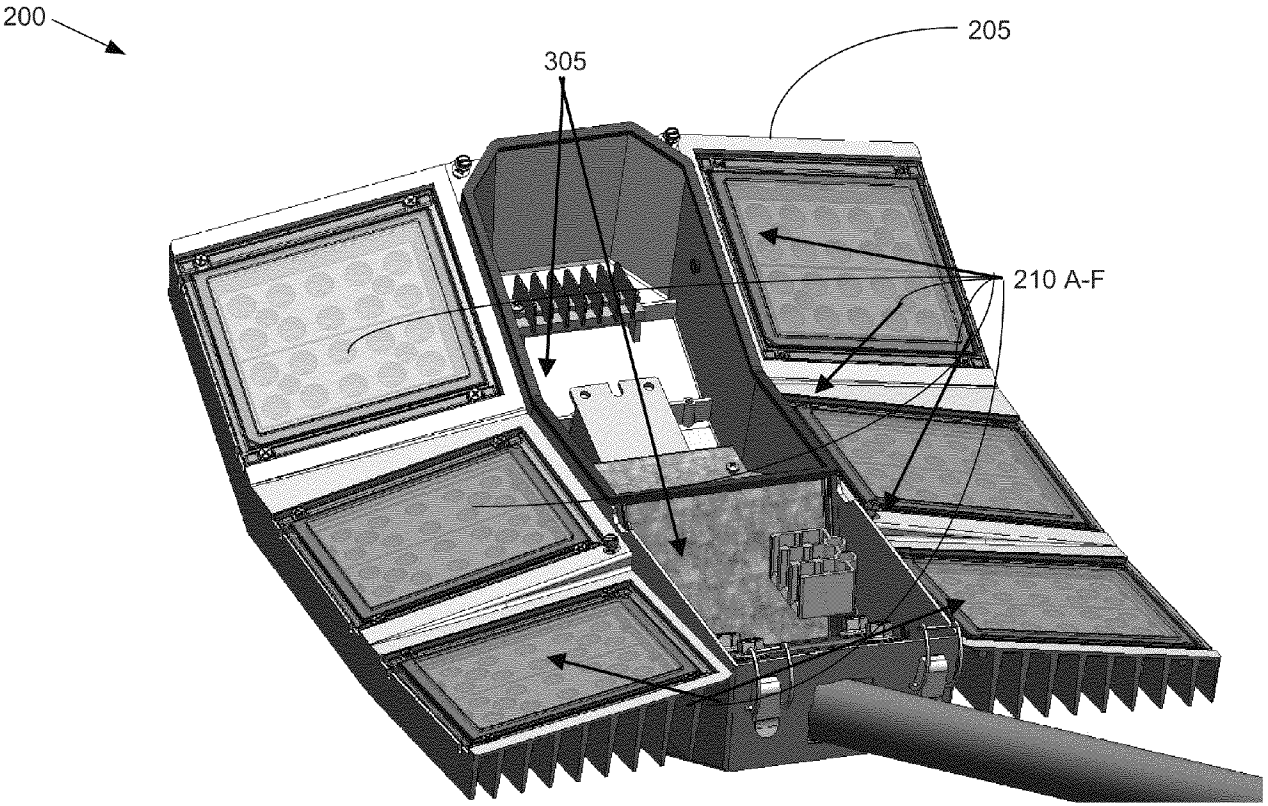
FIG. 3 is a perspective view of a LED sign lighter with its center housing cover removed, according to one exemplary embodiment of the present invention.

FIG. 3 is another perspective view of the exemplary LED sign lighter 200 showing the internal electrical components under the compartment cover 215 according to one exemplary embodiment of the present invention. Referring now to FIG. 3, the housing 205 includes one or more recessed center compartments 305 positioned between at least two sets of LED modules 210 A-F. Each center compartment 305 is configured to accept electrical components (not shown), such as one or more LED drivers, timers, and/or photocells and associated wiring, within the center compartment 305. These electrical components provide proper power and operating parameters for the LED modules 210 A-F used in the housing 205. In an exemplary embodiment, power to at least six LED modules is provided by a Class 1 LED driver outputting roughly 150 watts of power. While a Class 1 LED driver is preferable, it is noted that the exemplary embodiment is not limited to the use of this specific type of LED driver or electrical power source. In another exemplary embodiment, two Class 2 LED drivers rated up to 100 watts and 60 volts are used to power the LED modules 210 A-F. Further, the compartment 305 in the center of the housing 205 is capable of being modified and configured to accommodate any number of LED drivers based on the design needs, the number of LED modules 210 A-F being disposed on the housing 205, and/or according to the specific requirements of the customer. Wiring of the LED drivers to the individual LEDs or LED modules (as the case may be) is well known in the art and for the sake of brevity will not be described herein.

Figure 4:
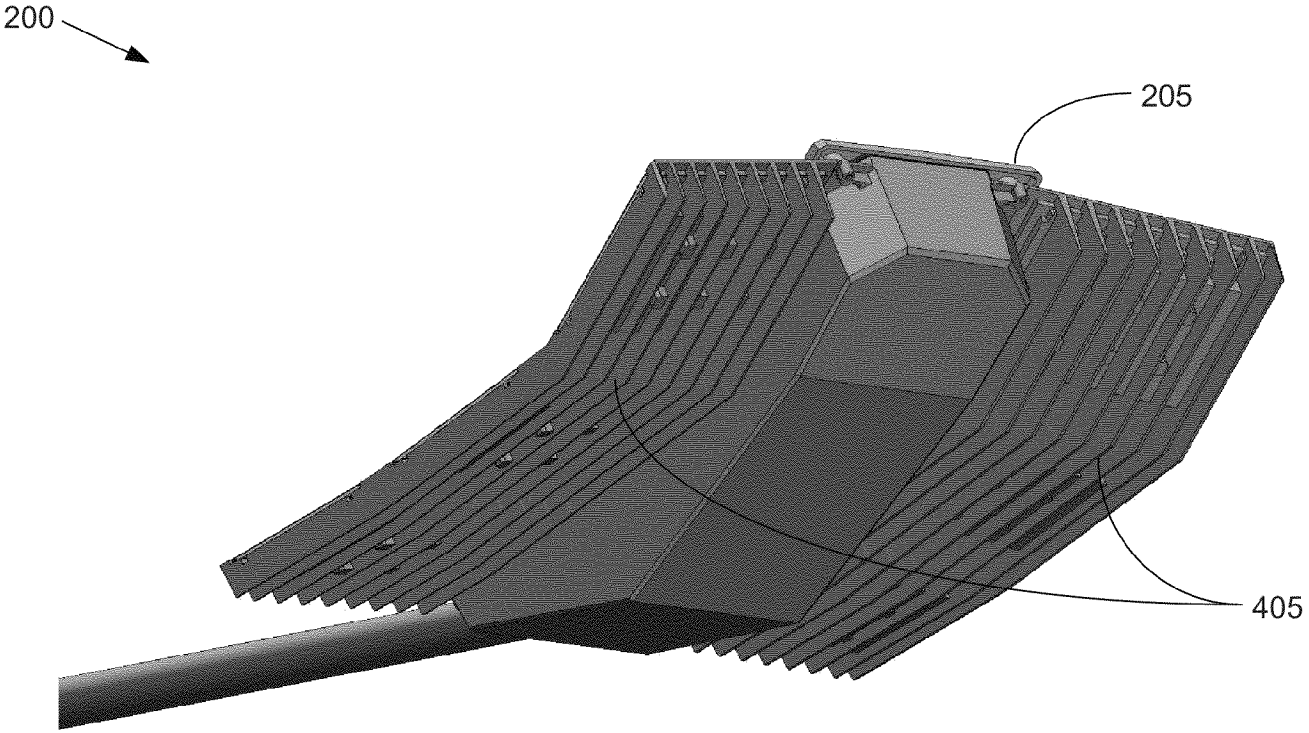
FIG. 4 is a rear side perspective view of a LED sign lighter, according to one exemplary embodiment of the present invention.

FIG. 4 illustrates a perspective rear view of the exemplary LED sign lighter 200. Now referring to FIG. 4, the LED sign lighter 200 also includes cooling fins 405 extending along the back side of the housing 205 and in thermal communication with the LED modules 210 A-F. While the exemplary embodiment of FIG. 4 shows the heat sink fins 405 being linear, extending along the longitudinal axis of the housing and spaced in a substantially equal manner, in alternative embodiments the fins 405 extend horizontally across the housing 205, radiate outward from a center point or multiple center points along the back of the housing 205, are curved or include a combination of curved portions and straight portions, and/or the spacing between each heat sink fin 405 is not equal. In one exemplary embodiment, each heat sink fin 405 is molded into the back of the LED sign lighter housing 205 and approximately located under one or more LED modules 205 (not shown in FIG. 4). By positioning the heat sink fins 405 directly underneath the LED modules 205, the contact area between the heat sink and the LED modules 205 is maximized thereby providing for maximum thermal efficiency for operation of the LED sign lighter 200.

Figure 5:
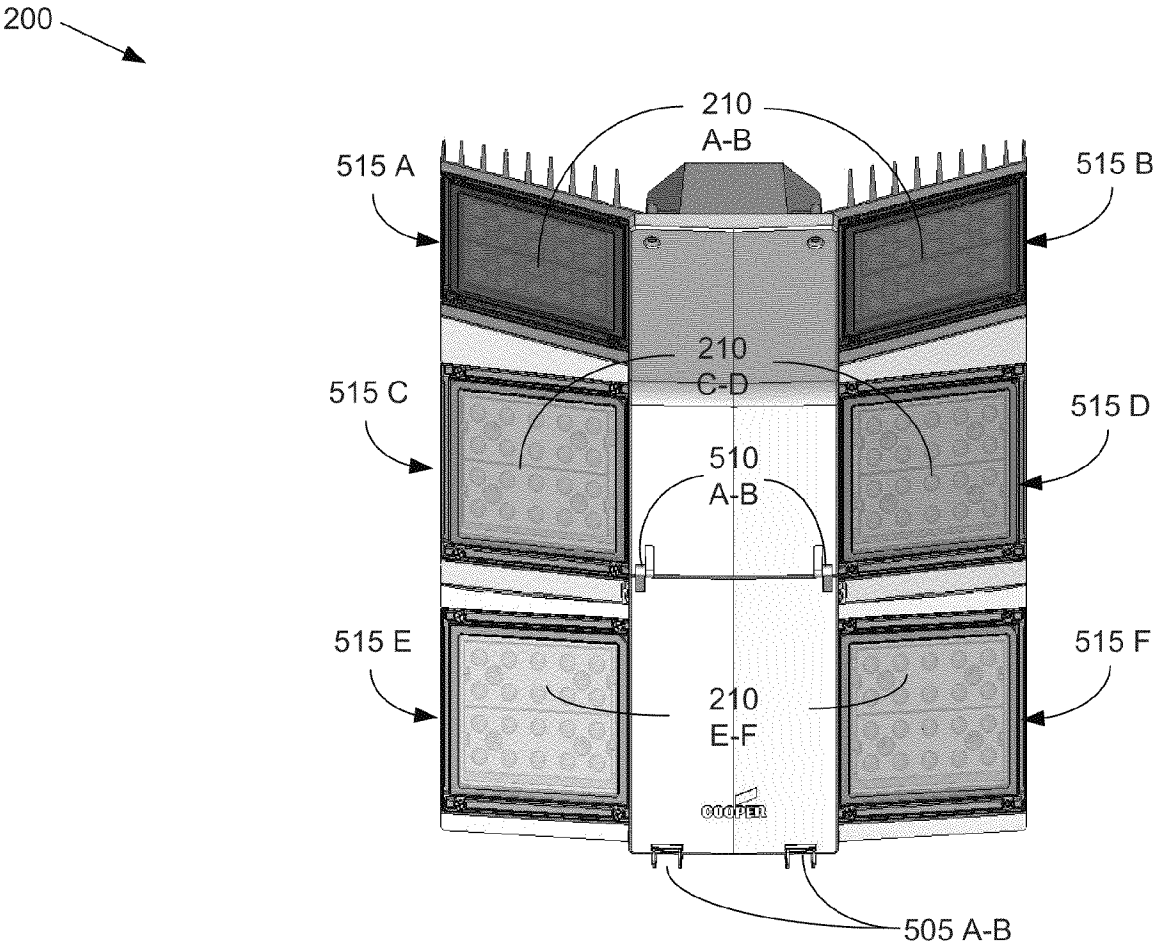
FIG. 5 is a top plan view of a LED sign lighter, according to one exemplary embodiment of the present invention.

FIG. 5 illustrates a top plan view of the exemplary LED sign lighter 200. Referring now to FIG. 5, in an exemplary embodiment, six LED modules 210 A-F are placed on and affixed to six corresponding platforms 515 A-F. In one exemplary embodiment, each LED module 210 A-F is affixed to its corresponding platform 515 A-F with one of fasteners, arctic silver, solder joints, plugs, epoxy, bonding lines or double-sided heat tape. Examples of fasteners include, but are not limited to, screws, nails, bolts, rivets, a cam-lock switch, a pushbutton plunger, or other device known to those of ordinary skill in the art having the benefit of this disclosure. Further, in certain exemplary embodiments, the bottom side of each platform 515 A-F is in direct thermal contact with the heat sink in general and one or more of the heat sink fins 405 particularly, to efficiently transfer heat from the LED module 210 A-F, through the platform 515 A-F, to the heat sink fins 405, and to the surrounding environment by way of convection.

In one exemplary embodiment, each platform 515 A-F is a substantially flat planar surface that is disposed at an angle from the longitudinal axis of the sign lighter 200. In order to prevent accumulation of moisture on the top surface of the sign lighter 200, in one exemplary embodiment, each of the platforms has at least a partially downward angle from the center of the sign lighter 200 to the outer edge of the platform 515 A-F to channel water from the center of the fixture to the outer edges of the platforms 515 A-F and off of the sign lighter 200. In certain exemplary embodiments, the angle of disposition from the longitudinal axis is different for each platform 515 A-F. The different angles are selected based on a configuration that will direct the light being emitted by the particular LED module 210 A-F on the platform 515 A-F so that each module 210 A-F substantially illuminates a different portion of the sign. For example, when the sign lighter 200 includes the six platforms 515 A-F and the six LED modules 210 A-F disposed correspondingly thereon, the top LED modules 210 A-B are oriented toward the bottom of the sign; the middle LED modules 210 C-D are oriented toward the middle of the sign; and the bottom LED modules 210 E-F are oriented toward the top of the sign.

The exemplary LED modules 210 A-F include one or more LEDs (as described more fully below in relation to FIG. 9) and have a substantially square shape that matches or substantially matches the corresponding shape of the individual platforms 515 A-F. However, any size and shape LED module 210 and corresponding platform 515 may be used. The number of LEDs used in each LED module 210 is variable based on the amount of lumens per watt that is achievable from each LED, the number of platforms 515 and modules 210 and the particular design specifics for the particular use of the sign lighter 200. Accordingly, LED modules 210 having varying numbers of discreet LEDs is within the spirit and scope of the present invention.

As further illustrated in FIG. 5, the electrical component cover 215 also includes one or more latches 505 A-B and one or more hinges 220 (FIG. 2) to releasably secure the electrical component cover 215 to the LED housing 200 and to rotatably open the cover 215 about the hinges 220 to provide access to the electrical compartment 305.

Figure 6:
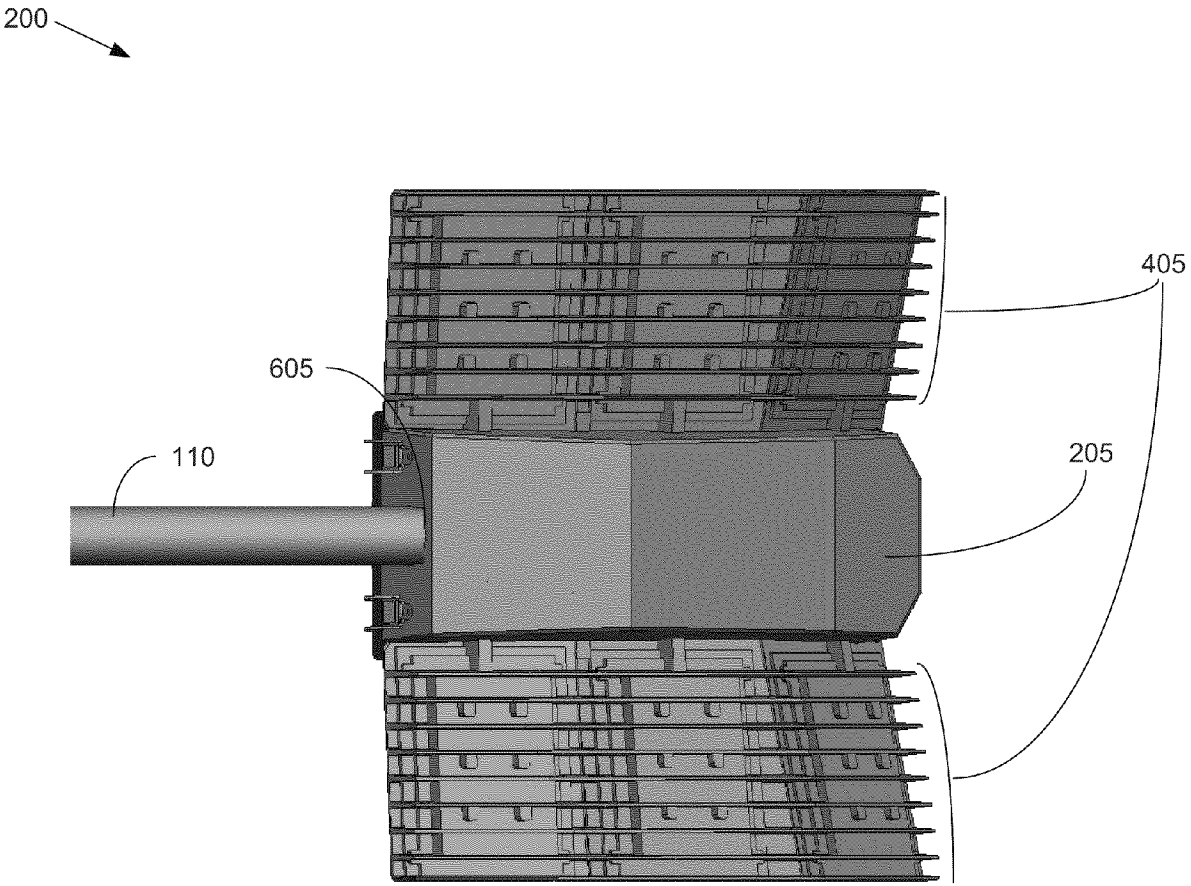
FIG. 6 is a bottom plan view of a LED sign lighter, according to one exemplary embodiment of the present invention.

FIG. 6 illustrates a bottom plan view of the exemplary LED sign lighter 200. Referring now to FIG. 6, the conventional sign holder 110 is inserted into a slot 605 on the housing 205, which is located on the bottom of the housing 205, thus allowing the LED sign lighter 200 to be used as a replacement for conventional sign lighters 200 by removing the conventional sign lighter 100 from the sign holder 110 and replacing it with the LED sign lighter 200 by coupling the LED sign lighter to the sign holder 110. In an exemplary embodiment, the conventional sign holder 110 is coupled to a portion of the housing 205 inside the center compartment 305 (not shown) through the use of bolts or other fasteners.

Figure 7:
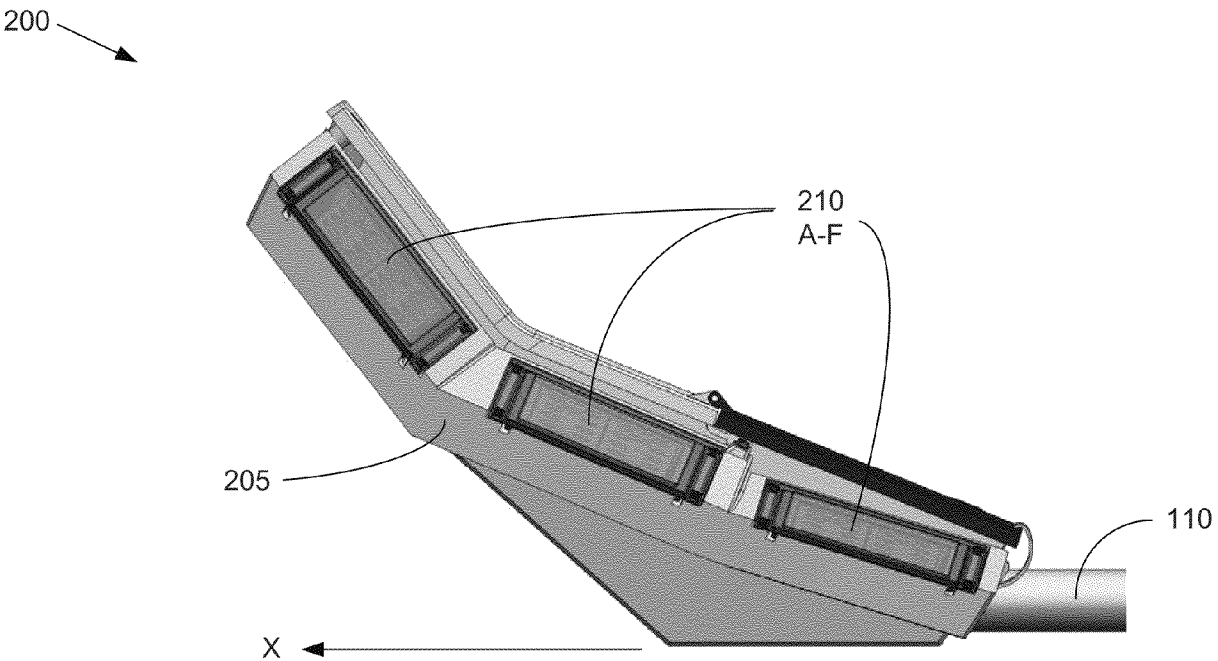
FIG. 7 is a left side elevation view of a LED sign lighter, according to one exemplary embodiment of the present invention.

FIG. 7 illustrates a left side elevation view of the exemplary LED sign lighter 200. Referring to FIG. 7, each LED module 210 is set at varying and increasing angles from the horizontal plane X, so as to point at various portions of a sign being illuminated (not shown). The LED modules 210 A-F are angled based on the pre-set angles of the housing 205. For example, the LED modules 210 A-F are sloped downward from the center section of the housing and gradually increase in angle from top to bottom of the housing as oriented from the horizontal plane X. While the illustrated slopes and angles are not limiting, they are preferably oriented such that the light is evenly distributed across the sign. Additionally, the gradual slope of the LED modules 210 A-5 is provided to help prevent elements, such as rain and snow, from accumulating on the top of the LED modules 210 A-F when in use.

Figure 8:
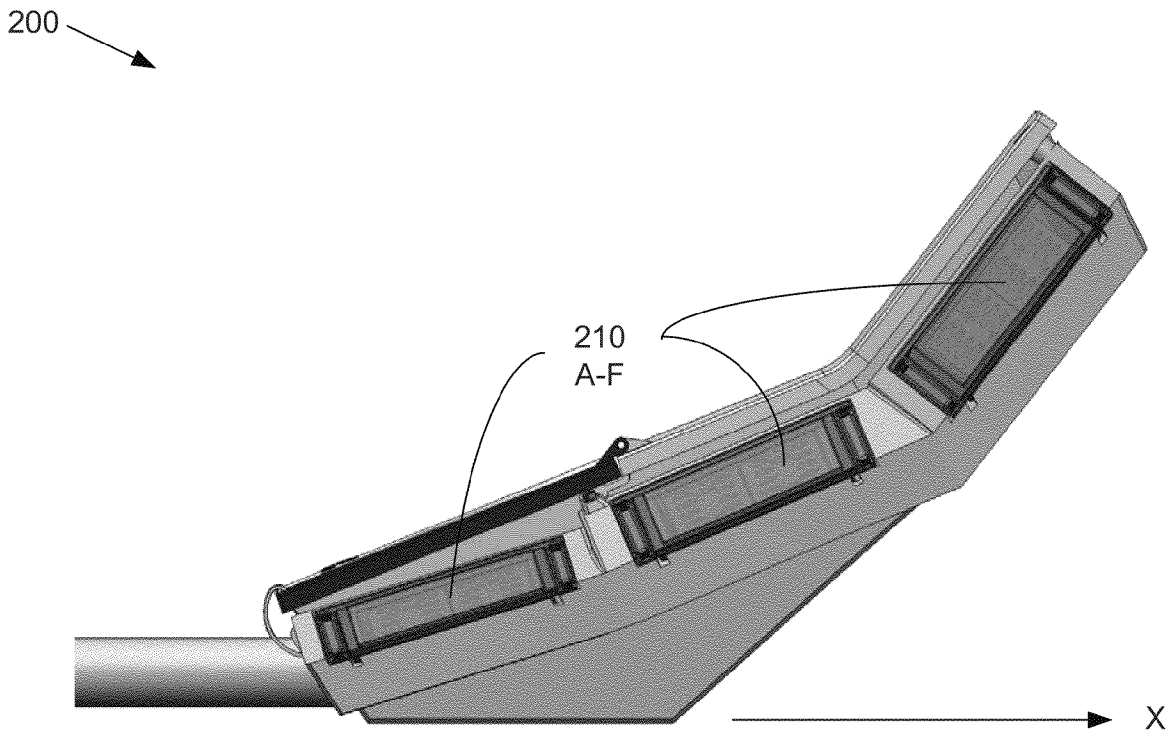
FIG. 8 is a right side elevation view of a LED sign lighter, according to an exemplary embodiment of the present invention.

FIG. 8 illustrates a right side elevation view of the exemplary LED sign lighter 200. Now referring to FIG. 8, as previously noted, in an exemplary embodiment, one or more LED modules 210 A-F are sloped downward and upwards in relation to a horizontal plane X. Further, the LED sign lighter is preferably symmetrical so that both sides of a sign are illuminated consistently. Therefore, the configuration for the left and right sides of the LED sign lighter 200 mirror one another in a preferred, yet exemplary, embodiment.

Figure 9:
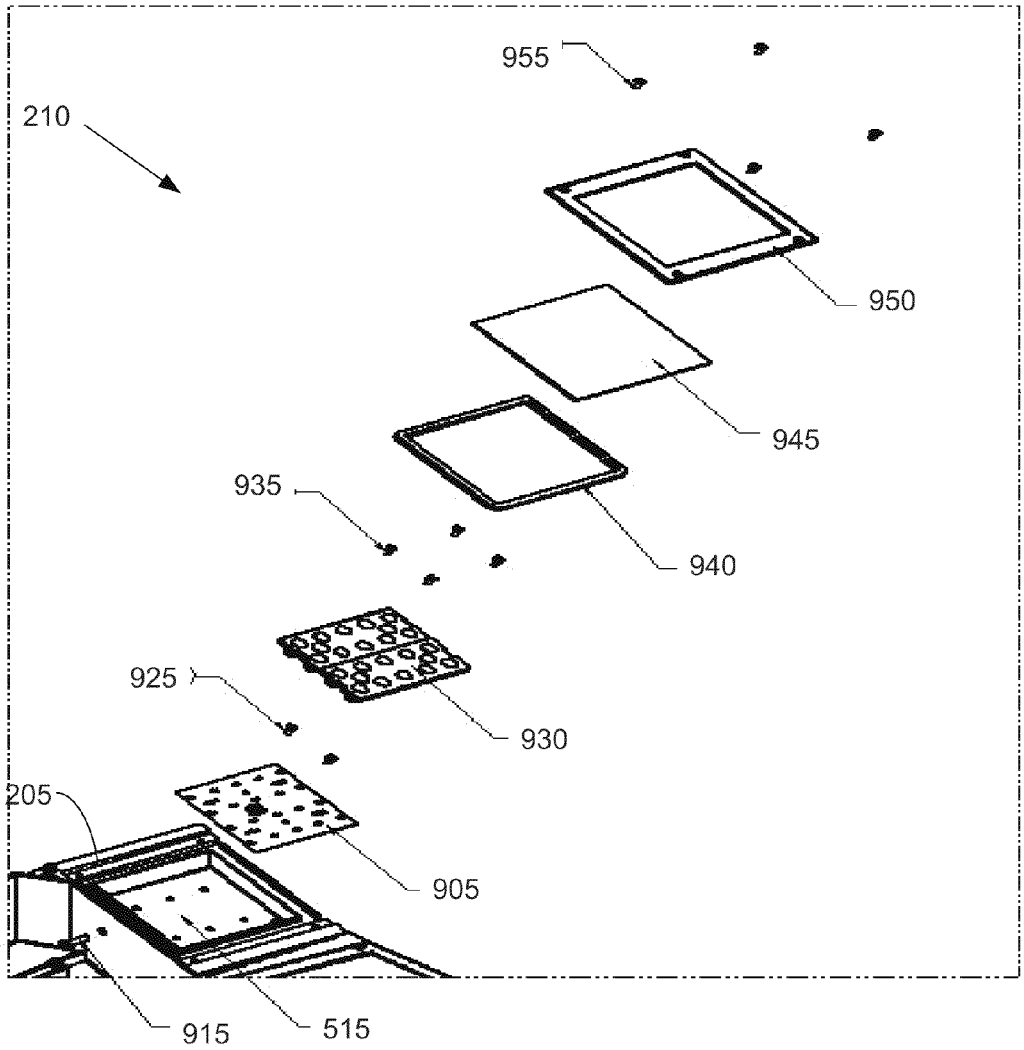
FIG. 9 is an exploded view of a LED module for use within the LED sign lighter of FIGS. 2-8, according to an exemplary embodiment of the present invention.

FIG. 9 is an exploded view of an LED module 210 for the exemplary LED sign lighter 200 according to one exemplary embodiment of the present invention. Referring now to FIG. 9, a substrate 905 is configured to fit on to a platform 515 that is part of the LED sign lighter housing 205 by a fastener 915. In an alternative exemplary embodiment, the substrate 905 is mounted to the platform 515 by one or more solder joints, plugs, epoxy or bonding lines, and/or other means for mounting an electrical/optical device on a surface. For example, the substrate 905 can be mounted to the platform 515 by a two-part arctic silver epoxy or double-sided heat tape. The substrate 905 includes one or more sheets of ceramic, metal, laminate, circuit board, mylar, or other material.

The substrate 905 accomodates one or more LEDs 925 A-n. In certain exemplary embodiments, the LEDs 925 are attached to the substrate 905 by one or more solder joints, plugs, epoxy or bonding lines, and/or other means for mounting an electrical/optical device on a surface. Each of the LEDs 925 includes a chip of semi-conductive material that is treated to create a positive-negative ("p-n") junction. When the LED 925 is electrically coupled to a power source, such as the LED driver (not shown), current flows from the positive side to the negative side of each junction, causing charge carriers to release energy in the form of incoherent light.

The wavelength or color of the light emitted from the LEDs 925 depends on the materials used to make the LEDs 925. For example, a blue or ultraviolet LED can include gallium nitride ("GaN") or indium gallium nitride ("InGaN"), a red LED can include aluminum gallium arsenide ("AlGaAs"), and a green LED can include aluminum gallium phosphide ("AlGaP"). Each of the LEDs 925 can produce the same or a distinct color of light. For example, the LEDs 925 can include one or more white LED's and one or more non-white LEDs, such as red, yellow, amber, or blue LEDs, for adjusting the color temperature output of the light emitted from the sign lighter 200. A yellow or multi-chromatic phosphor may coat or otherwise be used in a blue or ultraviolet LED to create blue and red-shifted light that essentially matches blackbody radiation. The emitted light approximates or emulates "white," incandescent light to a human observer. In certain exemplary embodiments, the emitted light includes substantially white light that seems slightly blue, green, red, yellow, orange, or some other color or tint. In certain exemplary embodiments, the light emitted from the LEDs 925 has a color temperature between 2500 and 5000 degrees Kelvin. In one exemplary embodiment, the LEDs 925 are an LED package that includes multiple LEDs mounted to the common substrate 905.

A reflector 930 for directing and focusing the light emitted by the LEDs 925 is disposed above and typically around the perimeter of each of the LEDs 925 (or the LED package as a whole). In one exemplary embodiment, the reflector 930 is made of aluminum or has a highly reflective surface to reflect the light generated by the LEDs 925 with minimal loss of efficiency. In one exemplary embodiment, the reflectors 930 for each of the individual LEDs 925 (or LED packages) are molded into a one or more reflector assemblies (as shown in FIG. 9); however, the use of individual, discrete reflectors for the LEDs 925 (or LED packages) is also contemplated within the scope of the exemplary embodiments. A seal 940 is disposed along the top surface of the reflector assembly 930 and about its perimeter and the perimeter of the substrate 905 to protect the substrate 905 and the LEDs 925 from contamination from environmental elements. In one exemplary embodiment, the seal 940 is one or many gasket materials know to those of or ordinary skill in the art. A translucent material (e.g., glass, lexan, acrylic or other clear or substantially clear material) 945 is positioned over the substrate 905, LEDs 925, reflector assembly 930, and the gasket 940 and allows light generated by the LEDs 925 to pass therethrough. A frame 950 is coupled to the housing 205 with one or more fasteners 955 A-n, such as screws, bolts, rivets, cam-locks and the like, to hold the LED module 210 components together within the housing 205 on its respective platform 515.

This above exemplary embodiment is by no means limiting. For example, the glass cover 945 could be replaced with a plastic cover under certain configurations. Additionally, over-optics may be used in place of the reflector 930 or the cover 945 to control the angle and direction of the light emitted from the LED module 210.

Figure 10:
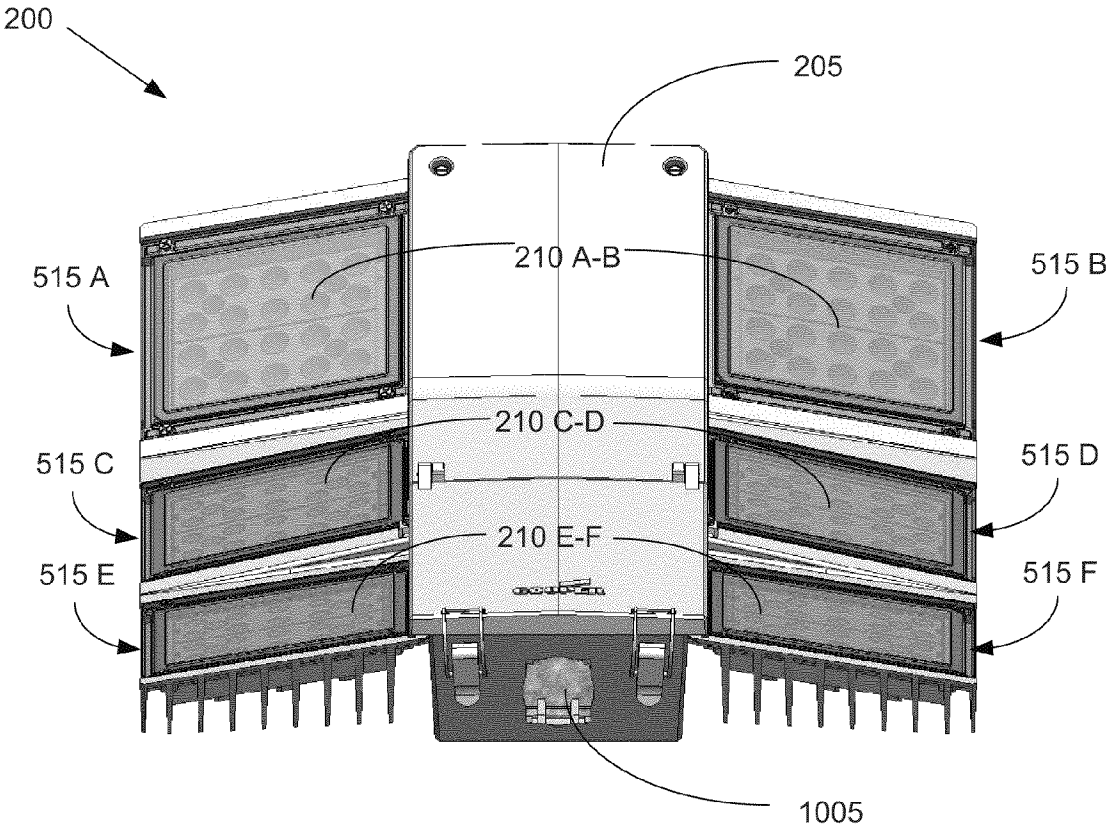
FIG. 10 is a front side elevation view of a LED sign lighter, according to an exemplary embodiment of the present invention.

FIG. 10 illustrates a front view of a LED sign lighter 200, according to an exemplary embodiment of the present invention. Referring to FIG. 10, In certain exemplary embodiments, the sign lighter 200 replaces conventional sign lights by using the mountable clasp 1005 on the bottom of the housing 205. The LED sign lighter 200 is then mounted on the end of a conventional sign holder 110 (FIG. 2).

In an exemplary embodiment, the LED sign lighter 200 is pre-fabricated to optimally light signs of varying sizes. When this is done, the angles of the platforms 515 A-B and the LED modules 210 A-B that are disposed thereon are pointed such that they face the bottom of the sign, and these LED modules 205 A-B preferably spread the light emitted in a wider angle than the other LED modules 205 C-F. Further, to evenly light a sign, platforms 515 C-D and LED modules 205 C-D that are disposed thereon are directed toward the middle portion of the sign, and platforms 515 E-F and LED modules 205 E-F that are disposed thereon are directed toward the top portion of the sign. In an exemplary embodiment, the bottom LED modules 205 E-F have the narrowest angle reflectors or over-optics, so as to efficiently direct light to the very top portion of the sign without excessive spill. Accordingly, in an exemplary embodiment, the middle modules 205 C-D have wider angle reflectors or overoptics than the bottom LED modules 205 E-F, but have narrower reflectors or over-optics when compared to the reflectors or over-optics used in the top LED modules 205 A-B.

Each LED module 205 A-F is quickly removable from the housing 205 with the use of simple hand tools, such as a screw driver, so that each individual module 205 may be quickly replaced. Additionally, each LED module 205 is preferably in series with one another so that a malfunctioning LED module 205 A-F will not affect other LED modules used to illuminate the sign.

The above exemplary embodiments are for illustration only. The exemplary embodiments and drawings discussed herein should not be considered to be limiting. One of ordinary skill in the art understands that other embodiments not described herein may likewise be used without departing from the spirit and scope of the present invention.

We claim:

1. A light emitting diode (LED) light fixture, comprising:
a housing comprising:
a front side comprising a plurality of platforms, each platform configured to accept one or more LED modules; and
a back side comprising a heat sink;
a plurality of LED modules, each LED module disposed on a corresponding platform, wherein each LED module on its corresponding platform is directed toward a different portion of a surface to be illuminated; and
an LED driver electrically coupled to at least one of the LED modules for controlling a plurality of LEDs on the LED module;
wherein a first LED module on a first of the plurality of platforms comprises a first reflector assembly, the first reflector assembly comprising a plurality of reflectors, wherein each reflector distributes light from the first LED module in a first pattern;
wherein a second LED module on a second of the plurality of platforms comprises a second reflector assembly, the second reflector assembly comprising a second plurality of reflectors, wherein each reflector distributes light from the second LED module in a second pattern different than the first pattern, wherein the first pattern is wider than the second pattern.

2. The LED light fixture of claim 1, wherein each LED module comprises:
an array of LEDs;
a reflector assembly comprising a plurality of reflectors, each reflector disposed adjacent to one of the LEDs in the array, wherein each reflector controls a light output from the adjacent LED; and
a substrate electrically coupled to the array of LEDs and mechanically coupled to a corresponding platform.

3. The LED light fixture of claim 2, wherein each LED module further comprises a translucent surface covering the array of LEDs, the reflector assembly and the substrate to protect the LED module from environmental contaminants.

4. The LED light fixture of claim 3, wherein each platform is disposed at an angle to horizontal plane to provide a low point of each platform along a perimeter of the housing to reduce an amount of environmental contaminants from accumulating on the LED module disposed on the platform during normal operations.

5. The LED light fixture of claim 2, wherein the LED module further comprises a plurality of over-optics, each over-optic disposed above at least one of the LEDs in the array for controlling light emitted by the LEDs.

6. The LED light fixture of claim 1, wherein the platforms and the heat sink are integral to one another and wherein the housing comprises a single diecast piece.

7. The LED light fixture of claim 1, wherein the LED sign lighter comprises six LED modules, a bottom two of the LED modules being angled to illuminate a top portion of a sign, a middle two of the LED modules being angled to illuminate a middle portion of the sign, and a top two of the LED modules being angled to illuminate a bottom portion of a sign.

8. The LED light fixture of claim 1, wherein the housing further comprises an electrical compartment formed between and adjacent to at least two platforms, and wherein the LED driver is disposed within the electrical compartment.

9. A housing for a light fixture, comprising:
a front side;
an opposing back side;
a first light emitting diode (LED) module affixed to the front side of the housing along a top portion thereof, wherein the first LED module is directed to illuminate a bottom portion of a surface;
a second LED module affixed to the front side of the housing along a middle portion thereof and generally below the first LED module, wherein the second LED module emits light that is directed to illuminate a middle portion of a surface;
a third LED module affixed to the front side of the housing along a bottom portion thereof and generally below the first and second LED modules, wherein the third LED module emits light that is directed to illuminate a top portion of a surface; and
a heat sink comprising a plurality of heat fins disposed along the back side of the housing to provide thermal efficiency for the first, second, and third LED modules.

10. The housing of claim 9, wherein each of the first, second, and third LED modules comprises a translucent outer surface and wherein each of the first, second, and third LED modules is angled vertically downward from a center of the housing towards a perimeter of the housing so as to reduce an amount of environmental contaminants that accumulates on each translucent surface.

11. The housing of claim 9, further comprising a Class 1 LED driver for providing electricity to the first, second, and third LED modules.

12. A light emitting diode (LED) light fixture, comprising:
a housing comprising a front side and an opposing back side;
six LED modules attached to the front side of the housing;
an LED driver electrically coupled to the six LED modules; and
at least one heat sink disposed along the back side of the housing and in thermal communication with at least a portion of the LED modules,
wherein a first and a second of the six LED modules are coupled to a top portion of the housing and are configured to illuminate a bottom portion of a surface;
wherein a third and a fourth of the six LED modules are coupled to a middle portion of the housing generally below the first and second LED modules and are configured to illuminate a middle portion of the surface; and
wherein a fifth and a sixth of the six LED modules are coupled to a bottom portion of the housing and configured to illuminate a top portion of the surface.

13. The LED light fixture of claim 12, wherein each of the six LED modules comprises:
an array of LEDs;
a reflector assembly disposed above the array of LEDs, the reflector assembly comprising a plurality of reflectors, each reflector disposed adjacent to one of the LEDs in the array, wherein each reflector controls a light output from the adjacent LED;

a substrate electrically coupled to the array of LEDs and mechanically coupled to the housing; and a translucent cover disposed above the array of LEDs, the reflector assembly and the substrate, the cover configured to permit light emitted from the array of LEDs to pass therethrough.

14. The LED light fixture of claim 12, wherein each of the six LED modules comprises:

an array of LEDs;

at least one over-optic for controlling the angle of the light emitted from the LEDs;

a substrate electrically coupled to the array of LEDs and mechanically coupled to the housing; and a translucent cover disposed above the array of LEDs, the over-optic and the substrate, the cover configured to permit light emitted from the array of LEDs to pass therethrough.

15. The LED light fixture of claim 11, further comprising an electrical compartment disposed between at first portion of the LED modules and a second portion of the LED modules, and wherein the LED driver is disposed within the electrical compartment.

* * * * *